US005666910A

United States Patent [19]

George, II et al.

[11] Patent Number: 5,666,910

[45] Date of Patent: Sep. 16, 1997

[54] STEAM GENERATOR

[75] Inventors: Paul E. George, II, Powell; William Wilkinson, Columbus; Donald Anson, Worthington, all of Ohio; Kurt Creamer, Plymouth, N.C.; Douglas Dickson; Michael J. Grassi, both of Columbus, Ohio; Steve Grimes, Westerville, Ohio

[73] Assignee: Gas Research Institute, Chicago, Ill.

[21] Appl. No.: 481,643

[22] Filed: Jun. 7, 1995

[51] Int. Cl.[6] ..... F22B 27/00

[52] U.S. Cl. ..... 122/40

[58] Field of Search ..... 122/31.1, 31.2, 122/32, 34, 40

[56] References Cited

U.S. PATENT DOCUMENTS

| | | | |
|---|---|---|---|
| 2,790,428 | 4/1957 | Buttler | 122/40 |
| 4,029,056 | 6/1977 | Wanson . | |
| 4,149,673 | 4/1979 | Hapgood . | |
| 4,579,087 | 4/1986 | Stol et al. . | |
| 4,765,280 | 8/1988 | Kobayashi et al. . | |
| 5,249,624 | 10/1993 | Pow et al. | 122/40 |
| 5,259,341 | 11/1993 | Person . | |
| 5,307,802 | 5/1994 | Placek . | |
| 5,329,886 | 7/1994 | Sylvester et al. . | |
| 5,335,629 | 8/1994 | Cornic . | |

FOREIGN PATENT DOCUMENTS

| | | |
|---|---|---|
| 89735/91 | 6/1992 | Australia . |

*Primary Examiner*—Noah P. Kamen

*Attorney, Agent, or Firm*—McAndrews, Held & Malloy, Ltd.

[57] ABSTRACT

An open steam generator system is disclosed which comprises a substantially enclosed vessel having an opening for exhausting steam generated and an opening for draining residual water from the vessel. Within the vessel also is a heat exchange coil having a heat transfer fluid circulating through its runs. The vessel also includes an injector for spraying water onto the heating coil to form steam. The disclosed steam generator achieves tolerance for low water quality by minimizing surface areas in contact with water. In addition, the system promotes self-cleaning of heat exchange surfaces using thermal shock to dislodge scale deposits.

11 Claims, 2 Drawing Sheets

STEAM GENERATOR

The invention relates to steam generating apparatus. One application of the apparatus is for cooking food, either by direct contact or in a heat exchange relationship. Additional applications include steam heating systems, commercial laundries, or other applications requiring modest quantities of steam to be generated with minimal water treatment.

BACKGROUND OF THE INVENTION

Conventional steam generators for such applications have employed drums, fire tubes or other heat exchange configurations having a submerged heat exchange surface. Scaling occurs on the submerged heat exchange surface which is in contact with hot flue gases and the water to be evaporated, resulting in a visible scale buildup. Corrosion due to dissolved oxygen and low pH water occurs at an accelerated rate at the water line. These corroded heat exchange surfaces are often difficult to replace or clean.

SUMMARY OF THE INVENTION

One objective of the disclosed steam generator is to provide apparatus which will tolerate acidic or basic water as well as water containing dissolved solids or oxygen. Tolerance for less than optimal water quality is achieved by minimizing the surface area in contact with the water so that the heat exchange surfaces may be cost effectively fabricated from corrosion and scaling resistant materials.

Another object of the disclosed steam generator design is to promote self-cleaning of the heat exchange surfaces by flexing the surface to cause dislodging of scale deposits. Surface flexing can result from thermal shock as water is sprayed on the hot surfaces. Surface flexing can also result from changes in the pumped fluid pressure or velocity which induced movement of the heat exchange surface. A further object of the disclosed steam generator is to adapt its components which come in direct contact with untreated water to be readily serviced or replaced using ordinary tools.

Another objective of the present steam generator is to quickly respond to load changes or steam demand, and to have a high capacity for steam generation in a compact design. Rapid heat up and quick response to load changes result from a low water inventory in the steam generator vessel.

The steam generator apparatus of the present invention comprises a substantially enclosed vessel having one or more openings for exhausting steam generated within the vessel and for draining residual water from the vessel. Within the vessel is a convoluted heat exchanger or generator coil with a series of runs. The coil is tubular to allow a heat transfer fluid to circulate through the runs. The vessel also includes an injector for distributing a quantity of water to be vaporized into contact with the heating coil runs. Steam is generated by evaporation of a thin film of water which flows downwardly over the convoluted runs of the generator coil.

This system provides several advantages over present steam generator systems. A low inventory of water allows rapid heat up and quick response to load changes. In addition, the low water inventory reduces or eliminates water-line corrosion and reduces the energy stored within the generator which could be released upon vessel failure. Because of high heat transfer rates achieved in the system, the steam generator vessel may be smaller than conventional vessels, allowing the use of corrosion resistant materials at modest cost. The steam generator coil may also be economically fabricated of corrosion and scaling resistant materials. Further, the present design permits the field replacement or servicing of components subject to corrosion and scaling.

BRIEF DESCRIPTION OF THE DRAWINGS

For a more complete understanding of the invention, reference should now be made to the embodiments illustrated in greater detail in the accompanying drawings and described below by way of an example of this invention.

Figure 1:
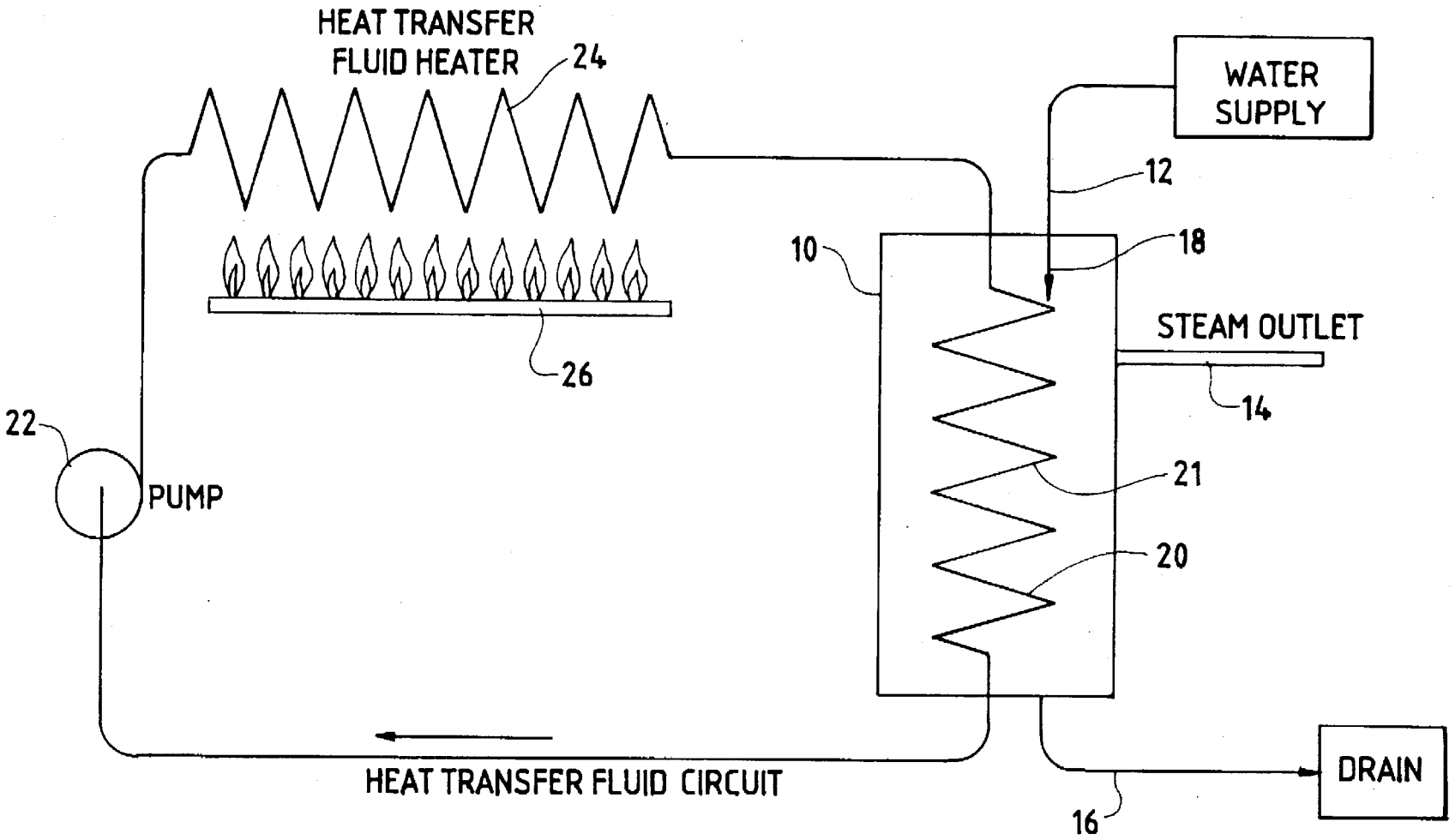
FIG. 1 is a diagrammatic view of a steam generator system of the present invention.

The following reference characters are used in the Figures.

10 generator vessel
12 water inlet
14 steam outlet
16 drain
18 injector
20 generator coil
21 generator coil run
22 pump
24 fluid heater
26 burner
28 separator tank
30 coil outlet
32 coil inlet
34 overtemperature switch
36 expansion tank
38 feedwater supply
40 steam trap
42 drain cooler
44 solenoid valve
46 safety valve

DETAILED DESCRIPTION OF THE INVENTION

While the invention will be described in connection with one or more preferred embodiments, it will be understood that the invention is not limited to those embodiments. On the contrary, the invention includes all alternatives, modifications, and equivalents as may be included within the spirit and scope of the appended claims.

The steam generator herein described is useful in an open steam generator system. In such a system, the generated steam is meant for use outside of the system without any significant recirculation of the steam. The disclosed system may also find use in closed systems, however. In general, closed systems capture and recirculate significant amounts of the steam formed within the system. An example of a closed system is an ammonia/water or lithium bromide/water refrigeration system.

FIG. 1 shows a simplified embodiment of the present invention. The steam generator system comprises two circuits, a steam generator circuit and a heat transfer fluid circuit. The steam generator circuit comprises a generator vessel 10 having a water inlet 12, a steam outlet 14 and a drain 16. The water inlet 12 includes an injector 18 or other means of supplying water to the generator coil 20. The injector 18 could comprise a nozzle or sprayer or the like. Alternatively, the injector 18 could be a simple dripping device such as a drip tray. The heat transfer fluid circuit comprises a generator coil 20, a pump 22, a fluid heater 24, and a burner 26.

In order to generate steam, a hot heat transfer fluid is circulated through the steam generator coil 20, and steam is generated by evaporation of a thin film of water flowing over the outside of the heated generator coil 20. The heat transfer fluid can be low viscosity mineral oil, pressurized water or combustion gases, for example. Alternatively, steam from a secondary source such as house heating steam may be used as the heat transfer fluid if the steam pressure and temperature are sufficiently high.

Figure 2:
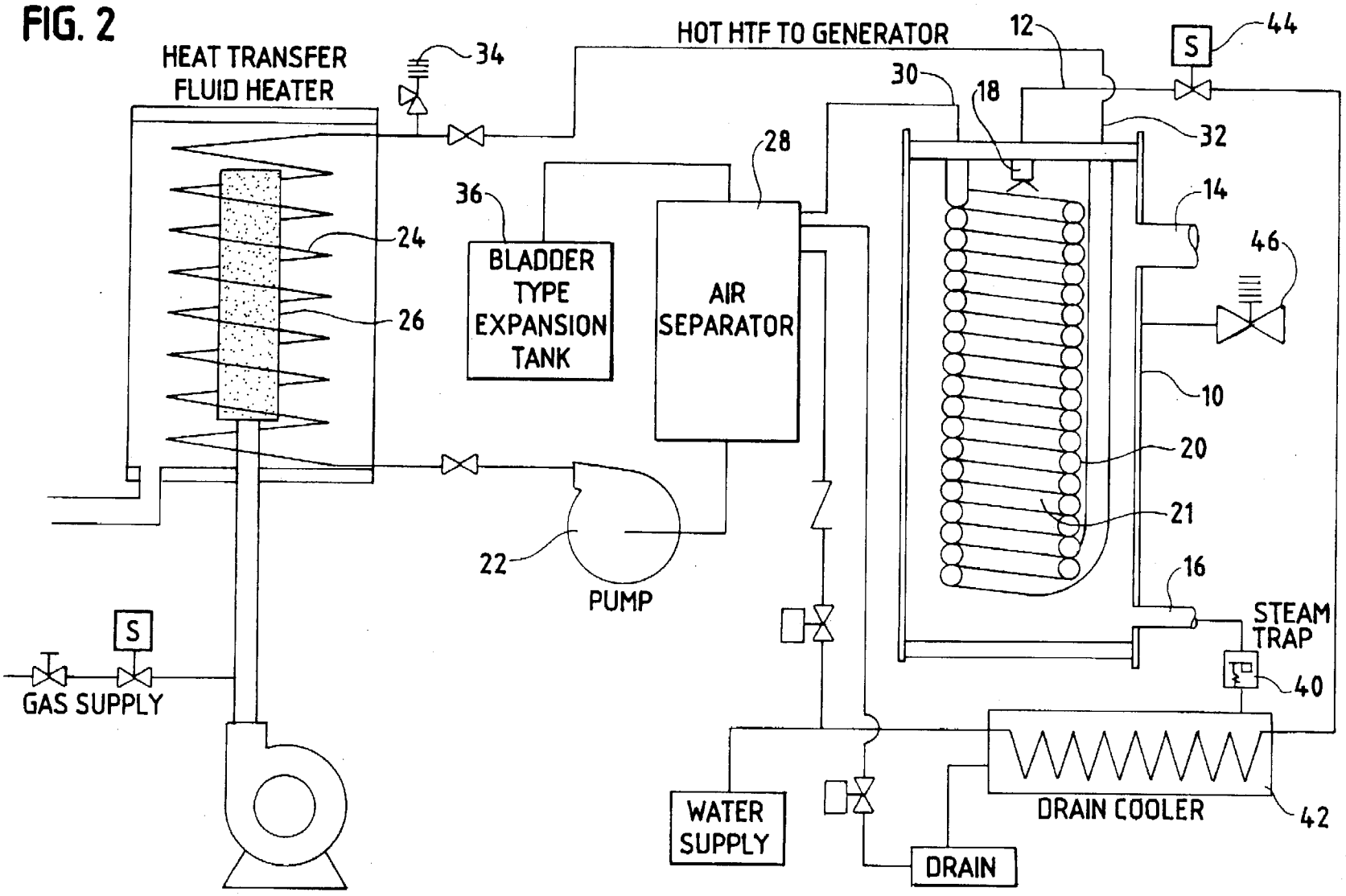
FIG. 2 is a more detailed diagrammatic view of a steam generator system of the present invention.

The generator coil 20 is a hollow tubular member, preferably constructed of copper or aluminum, formed into a series of closely spaced helical runs such as 21, shown in FIG. 2. Alternatively, the generator coil 20 could comprise a stamped plate heat exchanger. The generator coil 20 is positioned within the generator vessel 10. An injector 18 near the top of the vessel 10 sprays water to be vaporized onto the runs 21 of the generator coil 20. As water flows down the generator coil 20, it is heated and evaporates without substantial bubble formation. The resulting water vapor exits the vessel 10 through the steam outlet 14. Any water which is not evaporated will drip off the bottom of the generator coil 20 into the bottom of the vessel 10 and will flow out of the drain 16.

Typically, the heating and evaporation of untreated water, such as tap water, in an open generator causes concentration and precipitation of dissolved solids to form scale buildup on heat exchange surfaces. A beneficial aspect of the present design is that the steam generator coil 20 dislodges scale due to differential thermal expansion relative to the scale deposits. As water is sprayed on the heated generator coil 20, the surface of the coil 20 contracts from its equilibrium position without water spray. When the injector 18 is turned off, the generator coil 20 expands to regain an equilibrium length consistent with the temperature of the heat transfer fluid circulating through its runs 21. When the system is cycled (for example, warmed up in the morning and cooled down at the end of the day), the generator coil 20 expands and contracts even more due to larger changes in temperature. Changes in pressure and/or fluid velocity within the generator coil 20 also cause surface flexing.

Most scale deposits, such as lime, are brittle and have a lower coefficient of thermal expansion than the copper or aluminum of the generator coil 20. After a certain thickness of scale is reached, the less ductile scale dislodges with the expansion and contraction of the generator coil 20 and falls to the bottom of the generator vessel 10. The thickness necessary to cause dislodging of the scale is dependent upon the specific system construction and operation, and the specific composition of the dissolved solids in the untreated water used to generate the steam. Once dislodged, the scale deposits can be periodically removed from the bottom of the generator vessel 10 by manual or chemical cleaning. The steam generator coil 20 also flexes and dislodges scale when the pump 22 is cycled because of changes in fluid momentum through the runs 21 of the generator coil 20.

FIG. 2 is a more complete schematic showing various additional hardware necessary to accomplish generation of steam at a desired pressure, usually 2.0 to 5.0 bars (approximately 15 to 60 psig). Consider first the heat transfer fluid circuit comprising a pump 22, a fluid heater 24 with a gas fired burner 26, a steam generator coil 20, and a separator tank 28. When the steam generator system is operational, heat transfer fluid is circulated continuously by the pump 22 through the heater 24. From the heater 24, heat transfer fluid circulates through the steam generator coil 20 and returns to the pump 22 via the separator tank 28. Temperature sensors control the burner 26 to maintain the fluid temperature exiting the steam generator coil 20 at a desired temperature above the desired saturation temperature of the steam to be generated. For example, approximately 5° C. to 40° C. (approximately 10° to 80° F.) above the steam temperature. The choice of a temperature set point is dependent upon such factors as the desired maximum steam generation rate and steam generator coil material properties. Lower conductivity material requires higher heat transfer fluid temperatures to overcome the resistance of the generator coil 20 walls. Because heat transfer fluid is continually circulating during operation, the burner 26 may be controlled by monitoring the temperature of the heat transfer fluid without regard to the amount of steam being withdrawn from the system.

It is beneficial to monitor heat transfer fluid temperature at the outlet 30 of the steam generator coil 20, rather than at the coil inlet 32. By measuring the fluid temperature at the coil outlet 30, the burner controller can sense a drop in heat transfer fluid temperature as soon as water is sprayed on the generator coil 20, and therefore anticipate the need to turn on the burner 26 faster than if the coil inlet 32 temperature is monitored. The temperature of the heat exchange fluid exiting the heater 24 will be equal to the temperature of the heat exchange fluid entering the heater 24 plus the temperature rise within the heater 24. So long as the heat transfer fluid flow is adequate, the temperature of the heat exchange fluid leaving the heater 24 will be directly related to the coil inlet 32 temperature, and need not be controlled separately. An overtemperature switch 34 senses the temperature of the heat exchange fluid leaving the heater 24 and will stop the burner 26 if the temperature control system malfunctions. The overtemperature switch 34 also provides a safety shutdown in the case of a very low flow rate of the heat exchange fluid since the temperature rise through the heater 24 is dependent upon the flow rate.

The separator tank 28 removes air introduced during the filling of the heat transfer fluid circuit and any air induced into the circuit during operation. FIG. 2 shows a common water supply 38 for the heat transfer fluid circuit and the steam generator circuit. The heat transfer fluid circuit of FIG. 2 is a closed system, and the steam generator circuit is an open system. Thus, the water within the heat transfer fluid circuit is substantially recirculated and replaced only periodically, whereas the water supplied to the steam generator is meant for use outside of the system without any significant recirculation of the steam.

Under normal operating conditions, the separator tank 28 is filled with a heat transfer fluid such as water from the water supply 38. An expansion tank 36 provides for expansion of the heat transfer fluid as the system heats up. The expansion tank 36 is precharged with gas to insure adequate pressure throughout the heat transfer fluid circuit and to prevent cavitation of the pump inlet as the heat transfer fluid circuit is started. The design of the expansion tank 36 to maintain adequate pressure and to avoid overpressure during normal operation can be conventional. Use of an elastomer bladder or diaphragm expansion tank will also prevent air from being introduced into the system in case of a leak in the heat transfer fluid circuit.

The steam generator circuit includes a feed water supply 38, an injector 18, a generator vessel 10, a steam outlet 14, a drain outlet 16 with a steam trap 40, and a drain cooler 42. As shown in FIG. 2, the drain cooler 42 is in a heat exchange relationship with the feedwater supply 38, in order to preheat the water to be sprayed as well as cool the water to be drained.

Feed water is supplied to the injector 18 through a solenoid valve 44 whenever the pressure within the generator vessel 10 drops below the desired set point. For most food service applications, the set point would be 1.82 to 1.90 bars. For some applications such as steam jacketed kettles, the set point could be as high as 5.0 bars. For commercial laundry and other uses, higher set points are appropriate for the design of the generator vessel 10 and heat transfer fluid circuit.

If steam generation rates exceed demand, pressure in the generator vessel 10 will rise above the set point and the water will be turned off by the solenoid valve 44. However, the residual water on the generator coil 20 would continue to evaporate causing pressure to rise further. If steam is still being withdrawn from the vessel 10, the pressure rise will be small and will quickly drop, allowing the solenoid valve 44 to be opened again. On the other hand, if no steam is being withdrawn from the vessel 10, the pressure will rise until the residual water is evaporated or the pressure reaches the saturation pressure associated with the temperature of the heat transfer fluid circulating through the generator coil 20. Since pressure in the vessel 10 cannot exceed the saturation pressure associated with the heat transfer fluid temperature, however, the system is inherently safer than other systems which can reach extremely high pressures in case of burner runaway and safety valve failures.

A quadruple failure is necessary to cause a complete system failure: the steam pressure controller must fail to close the solenoid valve 44 so that water continues to be sprayed; the heat transfer fluid controller must fail to turn off the burner 26, driving temperatures higher; the overtemperature switch 34 in the heat transfer fluid circuit must fail; and, the safety valve 46 must fail to open. Such a series of failures is unlikely, and normally the overtemperature switch 34 in the heat transfer fluid circuit would open and stop the system prior to failure of the steam generator vessel 10.

To mitigate pressure overshoots during routine operation, an anticipator type control system that stops the water spray before the set point is reached is desirable, but not necessary. Typical pressure overshoots are on the order of 2.0 to 3.5 bars. So long as the vessel 10 is designed to withstand these pressures, they do not pose an operational problem.

In operation, the steam outlet 14 is opened upon a demand for steam, resulting in a sudden pressure drop within the vessel 10 because the storage capacity of the vessel 10 is small. The steam pressure controller senses this rapid drop, and the feedwater supply solenoid valve 44 opens the water line to reestablish steam pressure. Steam pressure oscillations can be minimized if the temperature of the heat transfer fluid is adjusted to produce a reasonable match between steam generation rates and operational loads. A useful option is to equip the system with a steam pressure controller that causes the heat transfer fluid temperature set point to increase if the vessel pressure stays low for too long a time period. This delay may indicate a demand greater than the current steam generation rate.

Steam is generated when water from the injector 18 contacts the generator coil 20 and forms an evaporating falling film. As shown in FIG. 2, the closely spaced helical spirals of the generator coil 20 help achieve this falling film effect. At low steam demand, however, the pressure within the vessel 10 may build up so rapidly that the water is shut off before establishing a steady film on the runs 21 of the generator coil 20, and all of the water may evaporate. Under higher load conditions, more frequent or longer spraying times establish a complete film of water. Any additional water will drip off the bottom of the generator coil 20 and flow toward the drain 16. The draining water passes through the steam trap 40 and into a drain cooler 42 before exiting the system. The drain cooler 42 may be either a dilution type system or a heat exchanger that transfers heat from the drain water to the entering feed water. The latter is preferred to maximize energy efficiency and minimize water usage.

As an alternative to the steam trap 40, a pressure relief valve may be used in the drain line. Under normal operation the relief valve would be set above the nominal pressure set point but below the saturation pressure corresponding to the heat transfer fluid temperature. As water accumulates in the bottom of the vessel 10, it will reach the bottom of the coil 20 and will generate steam at a greater rate than the falling film due to more complete coil coverage. This higher generation rate causes pressure to rise in the vessel 10 and opens the relief valve draining water to the drain cooler 42. Typically the drain would open as steam demand is reduced so that excess water is drained and vessel overpressure is mitigated.

Many other variations will suggest themselves to one of ordinary skill in the art. These changes and additions may be carried out without departing from the present invention. For example, the runs 21 of the generator coil 20 could be of any configuration depending upon the steam demand and the amount and type of solids suspended within the water used. Likewise, the height, width, or volume of the generator vessel 10 will vary with the application or steam demand required. Accordingly, many other expedients will readily suggest themselves to one of ordinary skill in the art, in view of the foregoing disclosure.

Thus, a steam generator has been disclosed which has a simplified construction relative to previous systems and is self-cleaning. It is expected that steam generators of the present design will typically be more efficient, will cost less, and require less maintenance then prior apparatus. The conditions resulting in water-line corrosion and/or scale buildup have been eliminated. Furthermore, the safety and cost of the system has been improved. Thus, one or more objects of the present invention have been met by the illustrated apparatus.

What is claimed is:

1. A steam generator apparatus comprising:

a vessel having walls defining an interior surface, said surface having a first opening adapted for exhausting steam generated within said vessel and a second opening adapted for draining residual water;

at least one substantially convoluted heating coil located within and substantially entirely spaced apart from and substantially only surrounded by said interior surface of said vessel, said heating coil comprising a series of runs, an inlet communicating through said vessel walls, and an outlet communicating through said vessel walls, said inlet and said outlet adapted to circulate a heat transfer fluid through said runs; and, an injector for distributing a quantity of water to be vaporized substantially into contact with said runs.

2. The apparatus of claim 1, wherein said injector is a spray nozzle.

3. The apparatus of claim 2, wherein said injector is adapted to intermittently spray a quantity of water to be vaporized substantially into contact with said runs.

4. The apparatus of claim 1, wherein said convoluted runs include a series of helical spirals.

5. The apparatus of claim 4, wherein said helical spirals are substantially adjacent one another.

6. The apparatus of claim 1, further comprising a drain cooler for collecting residual water from said second opening of said vessel, said drain cooler positioned in a heat transfer relationship with a conduit supplying water to said injector.

7. The apparatus of claim 1, further comprising a heater for heating said heat transfer fluid from said heater coil outlet and for circulating hot heat transfer fluid to said heater coil inlet.

8. The apparatus of claim 6, further comprising a control system for sensing the temperature at said heater coil outlet and signalling said heater to maintain said heat transfer fluid within a predetermined temperature range.

9. A method of reducing scale deposits on a heat exchange coil of a steam generating system, comprising the steps of:

providing a substantially convoluted freely exposed heating coil having a heat exchange surface, which is exposed to scale buildup, and a thermal expansion coefficient different from that of boiler scale;

circulating a hot heat transfer fluid through said heating coil, thereby raising the temperature of said coil and causing thermal expansion of said coil;

spraying a quantity of water on said heat exchange surface of said heating coil, the water and said heat exchange surface being of sufficiently different temperatures that thermal stresses induce said surface to flex, thereby dislodging scale deposits.

10. The method of claim 8, further comprising the step of intermittently spraying ambient water on said heat exchange surface of said heating coil.

11. The method of claim 8, further comprising the step of intermittently circulating a hot heat transfer fluid through said heating coil.

* * * * *